US007771139B2

(12) United States Patent
Grahl

(10) Patent No.: US 7,771,139 B2
(45) Date of Patent: Aug. 10, 2010

(54) CONCRETE TROWEL TRANSPORT SYSTEM

(75) Inventor: Scott Grahl, St. Cloud, WI (US)

(73) Assignee: Wacker Neuson Corporation, Menomonee Falls, WI (US)

( * ) Notice: Subject to any disclaimer, the term of this patent is extended or adjusted under 35 U.S.C. 154(b) by 313 days.

(21) Appl. No.: 11/839,967

(22) Filed: Aug. 16, 2007

(65) Prior Publication Data

US 2009/0047070 A1 Feb. 19, 2009

(51) Int. Cl.
*E01C 19/22* (2006.01)

(52) U.S. Cl. ..... 404/112

(58) Field of Classification Search ..... 404/118, 404/112

See application file for complete search history.

(56) References Cited

U.S. PATENT DOCUMENTS

| | | | | |
|---|---|---|---|---|
| 2,621,568 | A | 12/1952 | Fletcher | |
| 2,898,826 | A | 8/1959 | Livermont | |
| 2,983,203 | A | 5/1961 | Fletcher | |
| 3,901,616 | A * | 8/1975 | Greening | 404/102 |
| 4,113,403 | A * | 9/1978 | Tertinek et al. | 404/113 |
| 4,710,055 | A | 12/1987 | Maass et al. | |
| 5,088,799 | A | 2/1992 | Redmon et al. | |
| 5,238,323 | A | 8/1993 | Allen et al. | |
| D340,340 | S | 10/1993 | Allen | |
| 6,059,299 | A | 5/2000 | Rust | |
| 6,347,907 | B1 * | 2/2002 | Halstead | 404/85 |
| D465,897 | S | 11/2002 | Smith | |
| D518,070 | S * | 3/2006 | Schennach | D15/20 |
| 7,204,657 | B2 * | 4/2007 | Jackson | 404/85 |

OTHER PUBLICATIONS

Dynapac, BG76 Power Trowels (3 pages).
Multiquip, Ride-On Power Trowels, Hydrostatic and Mechanical Drive Models (2 pages).
Photograph of Barikell Prior Art Wheel Kit (1 page).

* cited by examiner

*Primary Examiner*—Raymond W Addie
(74) *Attorney, Agent, or Firm*—Boyle Fredrickson, S.C.

(57) ABSTRACT

A self-propelled concrete finishing trowel has a transport system or dolly that allows the towel to be moved manually. The transport system includes wheels that are connected to a frame of the trowel by a connector such as a rotatable shaft. A single lift device such as a jack is coupled to the connector such that operation of the lift device translates both wheels relative to the frame. The transport system allows a user to quickly deploy the wheels for non-use transportation. The wheels are also located within the footprint of the trowel so as not to interfere with a finishing operation and are positioned to maximize stability.

21 Claims, 4 Drawing Sheets

CONCRETE TROWEL TRANSPORT SYSTEM

BACKGROUND OF THE INVENTION

1. Field of the Invention

The invention relates generally to concrete finishing trowels and, more particularly, to a transport system for a powered finishing trowel. The invention additionally relates to a concrete finishing trowel, such as a riding trowel, having a transport system that allows unassisted manual movement of the trowel.

2. Description of the Related Art

A variety of machines are available for smoothing or otherwise finishing wet concrete. These machines range from simple hand trowels, to walk-behind trowels, to self-propelled riding trowels. Regardless of the mode of operation of such trowels, the powered trowels generally include one to three rotors that rotate relative to the concrete surface.

Riding concrete finishing trowels can finish large sections of concrete more rapidly and efficiently than manually pushed or guided hand-held or walk behind finishing trowels. Riding concrete finishing trowels typically include a frame having a cage that generally encloses two, and sometimes three or more, rotor assemblies. Each rotor assembly includes a driven shaft and a plurality of trowel blades mounted on and extending radially outwardly from the bottom end of the driven shaft. The driven shafts of the rotor assemblies are driven by one or more engines mounted on the frame and typically linked to the driven shafts by gearboxes of the respective rotor assemblies.

The weight of the finishing trowel, including the operator, is transmitted frictionally to the concrete surface by the rotating blades, thereby smoothing the concrete surface. The pitch of individual blades can be altered relative to the driven shafts via operation of a lever and/or linkage system during use of the machine. Such a construction allows the operator to adjust blade pitch during operation of the power trowel. As commonly understood, blade pitch adjustment alters the pressure applied to the surface being finished by the machine. This blade pitch adjustment permits the finishing characteristics of the machine to be adjusted. For instance, in an ideal finishing operation, the operator first performs an initial "floating" operation in which the blades are operated at low speeds (on the order of about 30 rpm) but at high torque. Then, the concrete is allowed to cure for another 15 minutes to one-half hour, and the machine is operated at progressively increasing speeds and progressively increasing blade pitches up to the performance of a finishing or "burning" operation at the highest possible speed—preferably above about 150 rpm and up to about 200 rpm.

During use, the riding trowel is supported by the engagement between the number of blades and the underlying concrete material. To some extent, the weight of the machine assists the finishing process. Although the weight of the machine can be beneficial for providing efficient, robust, and powerful trowel operation, the weight of the machine is also detrimental to non-use transportation of the trowel, i.e. while moving the trowel to or from a worksite without operating the blades. Commonly, supplemental equipment, such as a skid loader, a backhoe, or the like, is utilized to move the machine to and from a work surface. Some concrete finishing trowels are fitted with lift points for attachment to a chain for this purpose. Alternatively, when no such equipment is available or the trowel must be used in a location which is not accessible by such equipment, two or more laborers are required to manually lift and move the machine. This is a labor some and physically demanding means of moving such machines.

Previous trowel transport systems have been disclosed which include a number of retractable wheels or casters that are securable to the frame of the trowel. One such system is a removable wheel kit or dolly disclosed in U.S. Pat. No. 5,238,323 to Allen et al. The wheel kit disclosed in the Allen '323 patent includes a pair of wheel assemblies secured to generally opposite sides of the exterior of the cage of a riding trowel. A separate jack is provided for each wheel assembly so that each jack independently raises and lowers a separate wheel assembly relative to the frame. When lowered, the wheels support the trowel such that a single user can move the entire trowel by simply pushing or pulling it in an intended direction. Although such systems enhance the mobility of power trowels, they are not without their drawbacks.

For instance, because the wheel assemblies of the Allen '323 patent are located outboard of the cage, they increase the overall footprint of the machine. Increasing the footprint of the machine increases the space occupied by the machine. Accordingly, it may prevent the machine from being transported in the beds of some trucks without removing the wheel assemblies. Increasing the footprint of the machine also detracts from a user's ability to position the machine close to the perimeter of a pour area or an obstacle in a pour area. This is problematic because users of finishing machines prefer that the machine finishes as much of the work surface as possible to reduce the need for hand work. In enclosed spaces, the wheel assemblies disclosed in the '323 patent, being positioned outside a normal footprint of the machine, are exposed to the obstacles, such as walls, posts, or the like, and thus increase an offset between an outer edge of the machine and an outer edge of the area finished by the blades. The areas that cannot be finished due to the interference between the wheel assemblies and the obstructions must be finished by hand, increasing the amount of hand work associated with a given pour. This problem can be avoided only by removing the wheel assemblies prior to commencing a finishing operation.

Transport systems such as the one disclosed in U.S. Pat. No. 5,238,323 are also relatively inefficient. To raise the machine, the operator must operate two separate jacks on opposite sides of the machine. In addition, unless care is taken to operate both jacks the same amount, one side of the machine may be higher than the other during transport, reducing the stability and maneuverability of the machine.

Accordingly, there is also a need for a transport system for a concrete finishing trowel that requires less effort than previously-known transport systems to be converted between a stowed position and a deployed operational position. There is also a need for an easily deployed concrete finishing trowel transport system that does not unnecessarily increase the footprint of the machine. It is further desired to provide a trowel transport system that can be implemented into a number of machine configurations as well as one that is relatively simple to operate, inexpensive to produce, and simple to maintain.

SUMMARY OF THE INVENTION

The present invention provides a power concrete finishing trowel transport system that meets one or more of the above-identified needs. A transport system according to one aspect of the invention includes at least two of spaced wheels that are concurrently movable by manipulation of a single lifting jack to adjust the position of both of the wheels relative to the blades of the finishing machine.

Another aspect of the invention is to provide a power concrete finishing trowel that meets the first principal aspect and that is simple to operate, does not substantially increase the weight of the finishing machine, and inexpensive.

Yet another aspect of the invention is to provide a power concrete finishing trowel with a transport system that meets one or more of the first and second aspects and that does not otherwise increase the footprint of the finishing machine.

One or more of these aspects are achieved by a transport system for a riding power trowel having a plurality of blades that are supported for rotation relative to a frame of the power trowel. The transport system includes a first wheel and a second wheel that are connected by a connector such as a shaft. A single lift device such as a jack or cylinder is connected to the frame and the connector such that operation of the lift device retracts or deploys the wheels. Such a transport system reduces the amount of time required to configure a trowel for transport.

A concrete finishing trowel for satisfying one or more of these aspects includes a frame and rotor assembly that extends downwardly from the frame. The rotor assembly has a shaft that supports a plurality of blades. An engine drives the shaft of the rotor assembly to translate the blades across a concrete material. The trowel includes a transport assembly having a connector that extends between a first wheel and a second wheel. A single lift device is engaged with the transport assembly such that operation of the single lift device concurrently moves the first wheel and the second wheel relative to the frame.

A method for satisfying one or more of the above aspects includes providing a power trowel having a frame and at least one rotor assembly that includes a rotatable shaft and a plurality of blades. The method includes concurrently manipulating a position of more than one support, such as wheels, that defines a distance between the plurality of blades and a supporting surface by operation of a lift device. Such a method allows a user to quickly and efficiently raise a power trowel in a generally level fashion.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
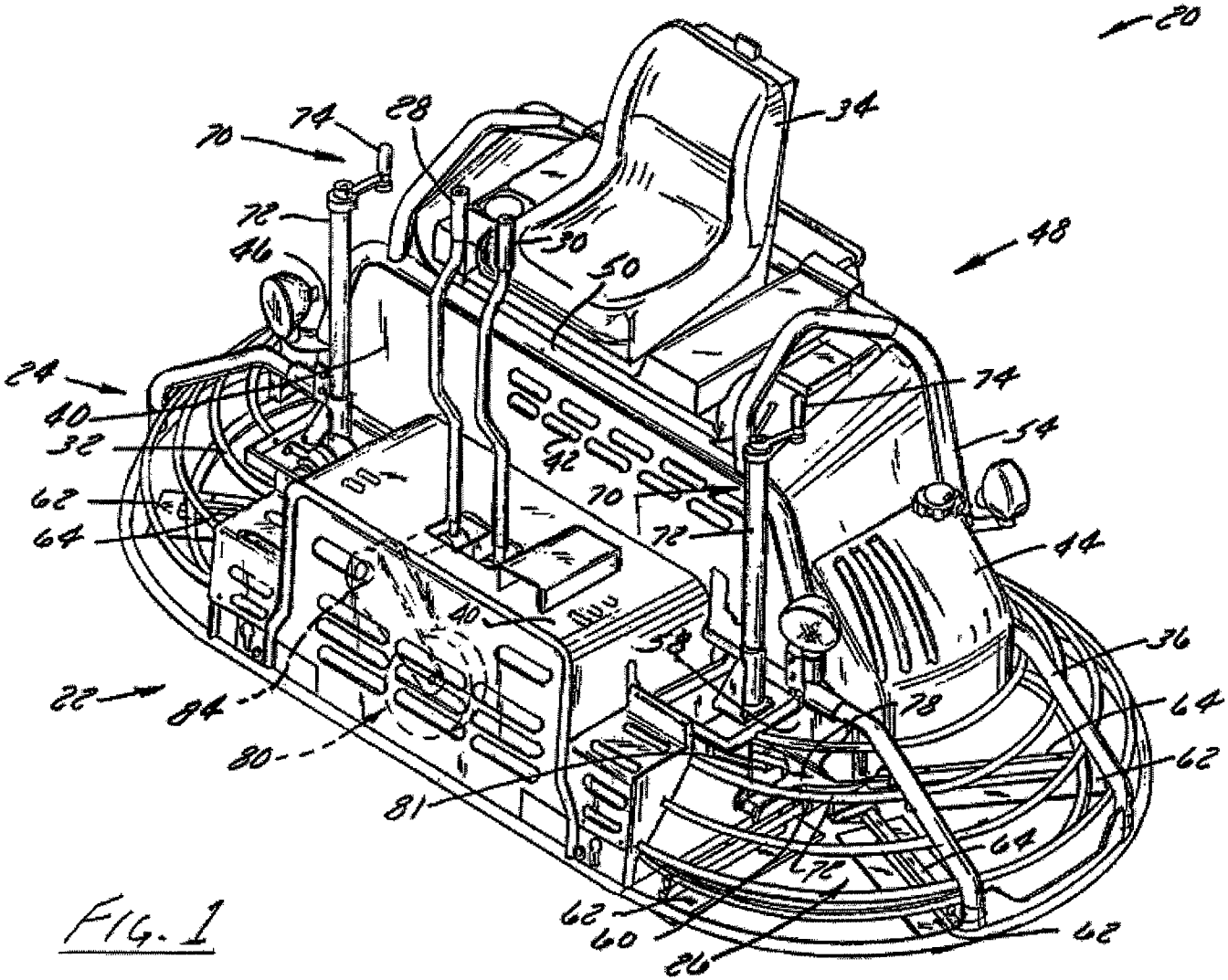
FIG. 1 is a perspective view of a riding power trowel equipped with a transport system according to present invention.

FIG. 1 shows a self-propelled riding concrete finishing trowel 20 equipped with a manual transport system or dolly 21 (FIGS. 2-4) that is constructed according to present invention and that is positioned nearly entirely beneath the shroud or cage of the trowel. Although shown as what is commonly understood as a riding or ride-on trowel, it is appreciated that the present invention is applicable to any powered concrete finishing trowel that cannot easily be manually moved by an operator without substantial physical effort. That is, it is conceivable that riding power trowels having configurations other than that shown, or even walk-behind trowels, could be equipped with a transport system according to the present invention.

Figure 2:
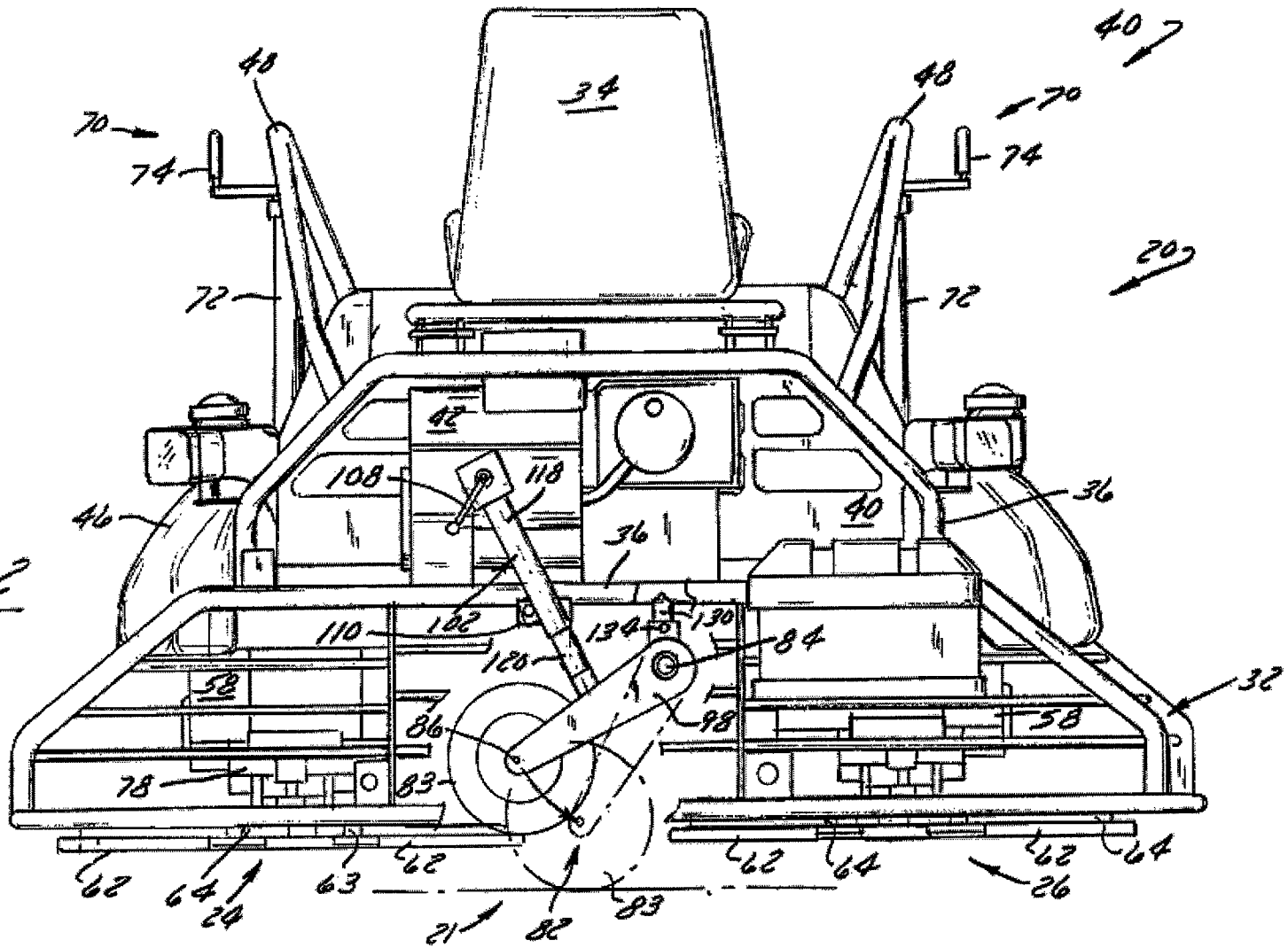
FIG. 2 is a rear elevational view of the power trowel shown in FIG. 1 with a center portion of a cage of the trowel being shown as cut away to expose a first wheel assembly of the transport system of the trowel.
Figure 3:
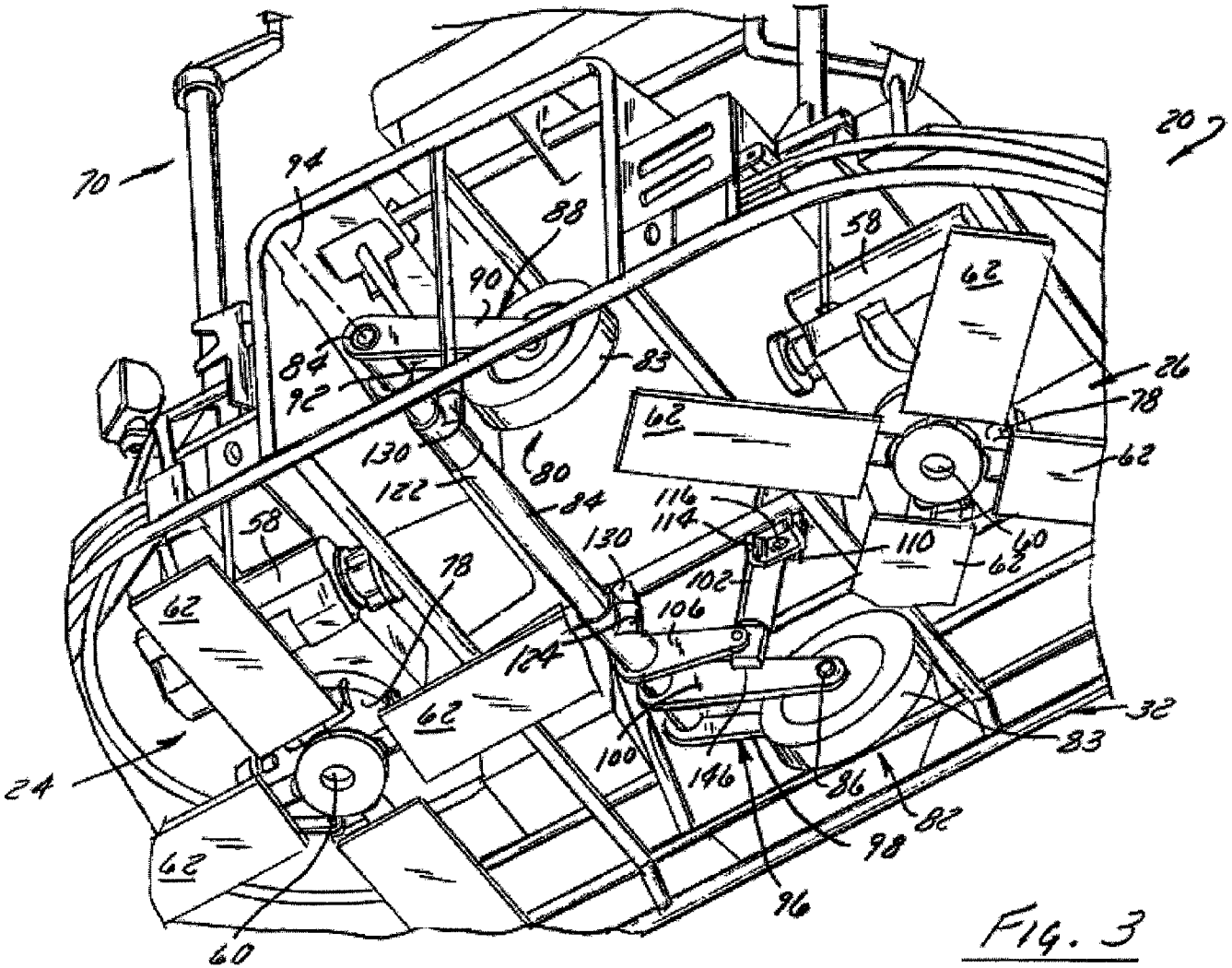
FIG. 3 is a perspective view of the underside of the trowel shown in FIG. 1.

Referring to FIGS. 1-3, and initially to FIG. 1 in particular, concrete finishing trowel 20 in accordance with a preferred embodiment of the invention includes as its major components rigid metallic frame 36, an upper deck 38 mounted on frame 36, an operator's platform or pedestal 40 provided on the deck, and right and left rotor assemblies 24, 26, respectively, extending downwardly from deck 38 and supporting the finishing machine 20 on the surface to be finished. The rotor assemblies 24 and 26 rotate towards the operator, or counterclockwise and clockwise, respectively, to perform a finishing operation. Cage 32 is positioned at the outer perimeter of machine 20 and extends downwardly from frame 36 to the vicinity of the surface to be finished. Cage 32 generally defines a footprint of power trowel 20. The pedestal 40 is positioned generally longitudinally centrally on deck 38 at a rear portion thereof and supports operator's seat 34. A fuel tank 44 is disposed adjacent the left side of pedestal 40, and a water retardant tank 46 is disposed on the right side of pedestal 40. A lift cage assembly 48, best seen in FIG. 1, is attached to the upper surface of the deck 38 beneath pedestal 40 and seat 34. Lift cage assembly 48 is used to transport power trowel 20 when supplemental equipment is available and/or for those application when manual movement of power trowel 20 is impractical, such as pours commonly associated with tall structures or loading of the machine onto raised flatbed vehicles.

Referring to FIG. 3, each rotor assembly 24, 26 includes a gearbox 58, a driven shaft 60 extending downwardly from the gearbox, and a plurality of circumferentially-spaced blades 62 supported on the driven shaft 60 via radial support arms 64 and extending radially outwardly from the bottom end of the driven shaft 60 so as to rest on the concrete surface. Each gearbox 58 is mounted on the undersurface of the deck 38 so as to be tiltable relative to deck 38 and frame 36 for reasons detailed below.

Referring to FIGS. 1-3, the pitch of the blades 62 of each of the right and left rotor assemblies 24 and 26 can be individually adjusted by a dedicated blade pitch adjustment assembly 70. Each blade pitch adjustment assembly 70 includes a generally vertical post 72 and a crank 74 which is mounted on top of the post 72, and which can be rotated by an operator positioned in seat 34 to vary the pitch of the trowel blades 62.

In the typical arrangement, a thrust collar (not shown) cooperates with a yoke 78 that is movable to force the thrust collar into a position pivoting trowel blades 62 about an axis extending perpendicular to the axis of the driven shaft 60. A tension cable 81 extends from the crank 74, through the post 72, and to the yoke 78 to interconnect the yoke 78 with the crank 74. Rotation of the crank 74 adjusts the yoke's angle to move the thrust collar 76 up or down thereby providing a desired degree of trowel blade pitch adjustment. The pitch of blades 62 is often varied as the material being finished sets and becomes more resistant to being worked by the blades. A power concrete finishing trowel having this type of blade pitch adjustment assembly is disclosed, e.g., in U.S. Pat. No. 2,887,934 to Whiteman, the disclosure of which is hereby incorporated by reference.

Both rotor assemblies 24 and 26, as well as other powered components of the finishing trowel 20, are driven by a power source such as internal combustion engine 42 mounted proximate or under operators seat 34. The size of engine 42 will vary with the size of the machine 20 and the number of rotor assemblies powered by the engine. The illustrated two-rotor 36" machine typically will employ an engine of about 20-25 hp.

Referring to FIGS. 1 and 2, trowel 20 additionally includes as a steering system 22 that steers machine 20 by tilting the driven shafts of the rotor assemblies 24, 26 of machine 20. Steering system 22 includes one, and preferably two, control arms or handles 28, 30 that extend beyond a shroud or cage 32 of trowel 20. Handles 28, 30 are oriented with respect to trowel 20 to be manipulated by an operator positioned in a seat 34. Handles 28, 30 are operationally coupled to rotor assemblies 24, 26 such that manipulation of handles 28, 30 manipulates the position of rotor assembly 24, 26 relative to a frame 36 of trowel 20, respectively. In the typical case in which the machine is laterally steered by pivoting a gearbox of at least one rotor assembly about two axes, at least one of handles 28, 30 is constructed to be movable in the fore and aft directions as well as side-to-side directions.

In use, as is typical of riding concrete finishing trowels of this type, the machine 20 is steered by tilting a portion or all of each of the rotor assemblies 24 and 26 so that the rotation of the blades 62 generates horizontal forces that propel machine 20. The steering direction is generally perpendicular to the direction of rotor assembly tilt. Hence, side-to-side and fore-and-aft rotor assembly tilting cause machine 20 to move forward/reverse and left/right, respectively. The most expeditious way to effect the tilting required for steering control is by tilting the entire rotor assemblies 24 and 26, including the gearboxes 58. The discussion that follows therefore will describe a preferred embodiment in which the entire gearboxes 58 tilt, it being understood that the invention is equally applicable to systems in which other components of the rotor assemblies 24 and 26 are also tilted for steering control.

More specifically, the machine 20 is steered to move forward by tilting the gearboxes 58 laterally to increase the pressure on the inner blades of each rotor assembly 24, 26 and is steered to move backwards by tilting the gearboxes 58 laterally to increase the pressure on the outer blades of each rotor assembly 24, 26. Crab or side-to-side steering requires tilting of only one gearbox (the gearbox of the right rotor assembly 24 in the illustrated embodiment), with forward tilting of right rotor assembly 24 increasing the pressure on the front blades of the rotor assembly 24 to steer the machine 20 to the right. Similarly, rearward tilting of rotor assembly 24 increases the pressure on the back blades of the rotor assembly 24 thereby steering machine 20 to the left.

Steering system 22 tilts the gearboxes 58 of the right and left rotor assemblies 24, 26 in response to manipulation of handles 28, 30 by the operator. Handles 28, 30 are connected to gearboxes 58 such that translations of one or both handles 28, 30 tilt or otherwise manipulate the position of gearboxes 58 relative to frame 36. Tilting of the gearboxes effectuates movement of the machine through the frictional and gravitational forces associated with passage of blades 62 over a concrete surface. It is appreciated that operation of blades 62 over non-pliable concrete surfaces is detrimental to machine performance, can result in unintended and jerky movement of the machine, and may damage machine 20. Accordingly, non-use movement of machine 20 means translation of machine 20 without interference of blades 62 with an underlying or supporting surface, such as the ground.

Figure 4:
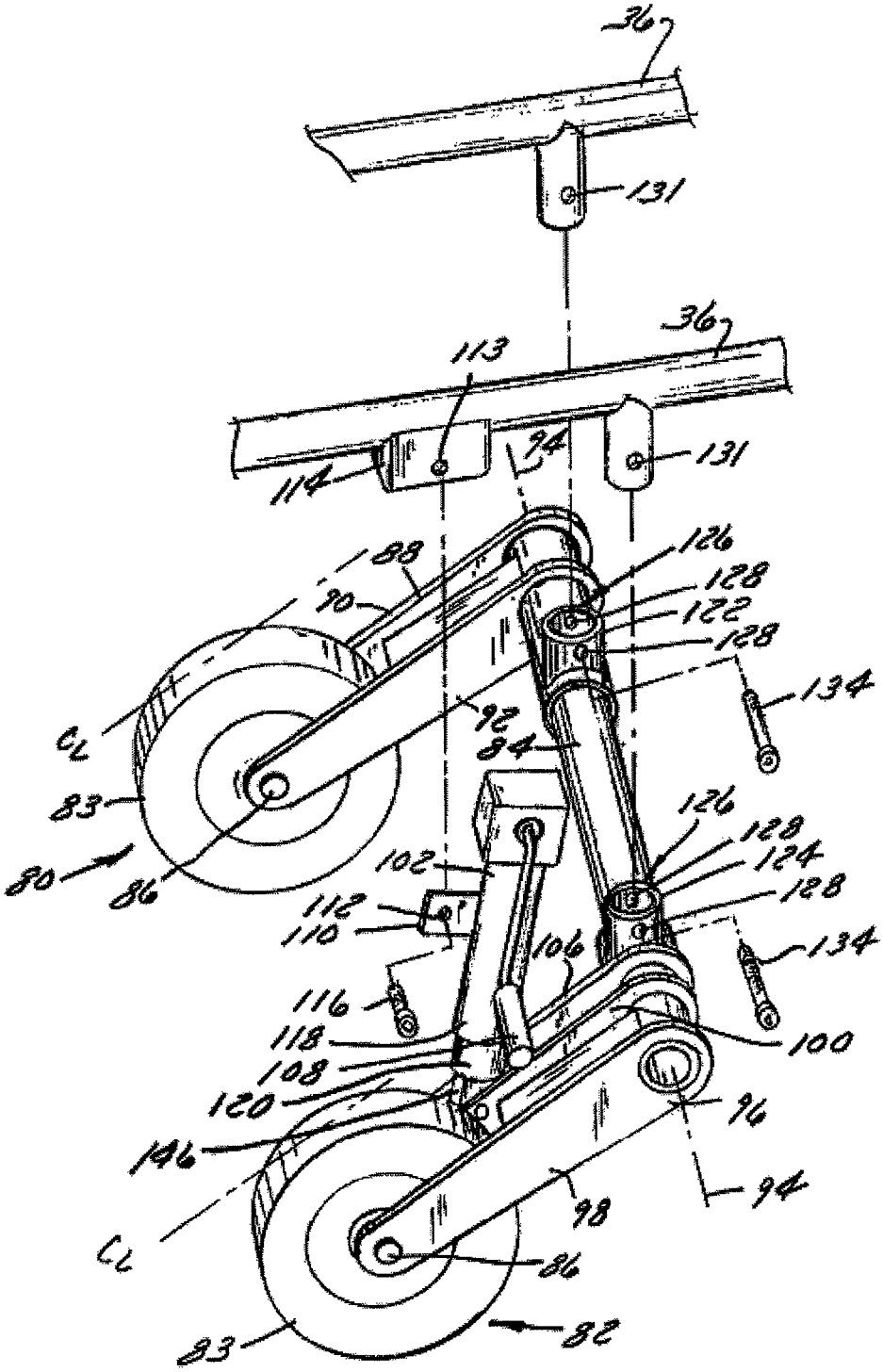
FIG. 4 is a perspective view of the transport system shown in FIG. 1 removed from the power trowel.

Referring to FIGS. 2-4, transport system or dolly 21 includes a first wheel assembly 80, a second wheel assembly 82, and a connector 84 extending therebetween and supporting the wheel assemblies 80 and 82. The first and second wheel assemblies 80 and 82 of this illustrated embodiment are located generally centrally of the frame and are spaced longitudinally from one another so as to be positioned in front of and behind the operator's seat 34, respectively. They are located just inside the perimeter of the cage 32 in the illustrated embodiment but could be spaced closer to one another, if desired, to accommodate other components of the machine such as frame components, steering system components, or drive system components. In the preferred embodiment, however, they should be spaced far enough apart to prevent or at least inhibit the machine from rocking. They also should not extend beyond the widest perimeter of the cage and, as such, should not increase the footprint of the machine 20. It should be noted that, rather than being spaced longitudinally from one another, the wheel assemblies 80 and 82 could instead be located on opposite sides of the machine and spaced from one another laterally rather than longitudinally as in the illustrated embodiment.

Each wheel assembly 80, 82 includes a wheel 83 that rotates about an axle 86. The axle 86 extends longitudinally of the machine 20 in the illustrated embodiment but, conceivably, could extend laterally or swivel. In fact, longitudinally extending axles would be preferred in a system in which the wheels are located at the sides of the machine 20 rather than at the front and rear. However, for multiple rotor machines that are wider than they are long, the illustrated longitudinally spaced wheels with coaxial longitudinal axles are preferred. In any event, the axial centerlines CL (FIG. 4) of the wheels 83 are spaced from one another. While only a single axle 86 and single wheel 83 are shown for each wheel assembly 80 and 82, two or more wheels could be provided on each axle 86, and multiple axles could be provided in each wheel assembly, if desired.

Each of the first and second wheel assemblies 80, 82 additionally includes a respective support 88, 96. First support 88 includes outer and inner spaced parallel arms 90 and 92 which support axle 86 at a location below an axis 94 of shaft 84. Second support 96 also includes an outer arm 98 and an inner arm 100 and offsets axle 86 of the wheel 83 of the second wheel assembly 82 below the axis 94 of shaft 84.

As shown in FIGS. 2, 3, and 4, a lift device in the form of a jack 102 extends through the rear of cage 32 and is operatively connected to shaft 84. Jack 102 includes a telescoping tube assembly including a first or outer tube 118 fixed to the frame 36 and a second or inner tube 120. The outer tube 118 is bolted to the frame 36 via flange 110 that extends from outer tube 118. Specifically, as best seen in FIG. 4, a pin 116 extends through an opening 112 in the flange 110 and into a mating opening 113 in a bracket 114 extending from frame 36. Pin 116 fixes a position of the outer tube 118 of jack 102 relative to frame 36. The inner tube 120 extends out of the inner tube 118 to a distal end 146 which is pinned to a jack arm 106 located inboard of the inner arm 100 of support 96 of wheel assembly 82. The jack arm 106 is fixed to the shaft 84 at its upper end. Operation of a handle 108 of jack 102 translates the inner tube 120 relative to the outer tube 118 to extend or retract the jack 102 to pivot the jack arm 106 and rotate to shaft 84. This rotation retracts or deploys the wheel assemblies 80, 82 as discussed below. Although jack 102 is shown as what is commonly referred to as a screw jack, it is appreciated that other jack configurations and constructions, such as scissor jacks, are envisioned and within the scope of the claims. It could also be coupled to the shaft by other than via the jack arm 106, such as being coupled directly to one of the supports 88 or 96. Other lift devices, such as a pneumatic or hydraulic cylinder or an electric actuator, could be used as well.

Referring to FIGS. 3 and 4, transport system or dolly 21 additionally includes a first coupler or collar 122 and a second coupler or collar 124 spaced from one another along the length of shaft 84. Each collar 122, 124 rotatably supports a respective end portion of the shaft 84 via a sleeve 123, 125. A cavity 126 is formed in each collar 122, 124 and is oriented generally transverse to axis 94 of shaft 84. A through hole 128 is formed in each collar 122, 124 and passes through cavity 126. As shown in FIGS. 3 and 4, frame 36 includes a pair of stub arms 130. Each stub arm 130 is constructed to slidably engage a cavity 126 of a respective collar 122, 124. A fastener 134 passes through the hole 128 of each collar 122, 124 and a mating hole 131 in the associated stub arm 130 to secures each collar 122, 124 to frame 36. The engagement of collars 122, 124 with stub arms 130 and flange 110 of jack 102 with bracket 114 secures transport system 21 to trowel 20 and fixes the position of axis 94 relative to machine 20.

The wheel assemblies 80, 82 are movable by the jack 102 between a non-use or stowed orientation shown in solid lines in FIG. 2 and a deployed or operational orientation 142 shown in phantom lines in FIG. 2. When the wheel assemblies 80 and 82 are in the stowed orientation, the wheels 83 of wheel assemblies 80 and 82 are located above the blades so that the machine 20 is supported on the blades 62. When the wheel assemblies 80, 82 are in the deployed orientation, the bottoms of the wheels 83 are positioned beneath the blades 62 between the rotors so that the wheel assemblies 80, 82 support the machine 20.

Referring to FIGS. 2 and 3, user manipulation of handle 108 of jack 102 translates the inner tube 120 of jack 102 relative to outer tube 118, thereby varying the distance between bracket 114 of frame 36 and the outer end 146 of the jack 102. This translation rotates jack arm 106 and shaft 84 about axis 94. Rotation of shaft 84 about axis 94 translates wheel assemblies 80, 82 from the stowed orientation shown in solid lines in FIG. 2 to the deployed or operational orientation shown in phantom lines in FIG. 2 in which the wheels 83 support machine 20. Because both wheel assemblies 80 and 82 are rotated by a common shaft 84, the wheel assemblies 80 and 82 are raised and lowered an equal amount by operation of a single jack 102. The operation of a single jack to effectuate a balanced change in elevation of machine 20 allows an operator to quickly and efficiently prepare the machine 20 for moving it from one job to another. Operation of the jack in the operation manner retracts the wheel assembly back to their stowed position shown in solid lines in FIG. 2, whereupon the machine 20 rests on the blades 62.

It is further appreciated that elevating trowel 20 with transport system 21 will also be beneficial for purposes other than transport. For instance, after a finishing operation, machine 20, including the underside of cage 32 and blades 62, must be cleaned to remove residual concrete materials from the machine. Transport system 21 can be deployed to elevate trowel 20 such that a user can quickly clean the underside of the machine. In addition, the wheel assemblies can be deployed to facilitate blade maintenance or replacement or to facilitate the installation of pans on the bottoms of the rotor assemblies.

Hence, the inventive system reduces operator effort to configure the riding trowel for non-assisted transportation, provides an efficient means of changing the elevation of the machine and does not adversely affect the footprint of the trowel.

It is appreciated that many changes and modifications could be made to the invention without departing from the spirit thereof. Some of these changes, such as its applicability to riding concrete finishing trowels having other than two rotors and even to other self-propelled powered finishing trowels, are discussed above. Other changes will become apparent from the appended claims. It is intended that all such changes and/or modifications be incorporated in the appending claims.

What is claimed is:

1. A transport system for a riding power trowel, the power trowel having a plurality of blades that are supported for rotation relative to a frame of the power trowel, and a cage that overlies and surrounds the blades, the transport system comprising:

first and second wheels having axial centerlines that are spaced from one another;

a connector that supports the first and second wheels on the frame; and a lift device that is operationally connected to the frame and that can be operated to concurrently raise the first and second wheels relative to the frame so that the blades are supported on the ground and to lower the first and second wheels relative to the frame so that the wheels engage the ground and forcibly lift the blades off the ground.

2. The transport system of claim 1, wherein the connector comprises a horizontal shaft that supports the first and second wheels, and wherein the operation of the lift device rotates the shaft to translate the first and second wheels.

3. The transport system of claim 2, wherein each of the first and second wheels is part of a respective wheel assembly including an arm having a first end connected to the shaft and a second end supporting the respective wheel.

4. The transport system of claim 1, wherein the lift device comprises a jack.

5. The transport system of claim 1, wherein the wheels are located fore and aft of a center of gravity of the power trowel, respectively, and are located on a longitudinal centerline of the trowel.

6. The transport system of claim 1, wherein the transport system has a footprint that is smaller than a footprint of the remainder of the power trowel.

7. The transport system of claim 6, wherein the wheels are located inside the cage.

8. The transport system of claim 1, wherein the wheels are coaxial.

9. A concrete finishing trowel comprising:

a frame;

at least one rotor assembly extending downwardly from the frame and having a shaft that supports a plurality of blades;

an engine that drives the shaft of the rotor assembly to translate the blades across a concrete material;

first and second wheels having axial centerlines that are spaced from one another;

a connector extending between the first wheel and the second wheel;

a single lift device that is coupled to the connector and the frame such that operation of the single lift device concurrently moves the first wheel and the second wheel relative to the frame from a stowed position in which the wheels are positioned above the ground and the blades are supported on the ground to a transport position in which the wheels engage the ground and forcibly lift the blades off the ground, whereafter the machine is supported solely on the wheels and the wheels are supported on the ground.

10. The concrete finishing trowel of claim 9, wherein the lift device comprises a jack.

11. The concrete finishing trowel of claim 10, wherein the jack includes a first portion having a fixed position relative to the frame and a second portion that is movable relative to the first portion.

12. The concrete finishing trowel of claim 10, further comprising a jack arm linking the jack to the connector such that operation of the jack rotates the connector.

13. The concrete finishing trowel of claim 9, wherein the connector crosses a lateral axis of the concrete finishing trowel.

14. The concrete finishing trowel of claim 9, wherein the connector comprises a shaft that supports the wheels and that is rotated by operation of the lift device.

15. The concrete finishing trowel of claim 9, further comprising a cage that overlies and surrounds the blades, and wherein the first and second wheels are located within the cage.

16. The concrete finishing trowel of claim 9, the wheels are located fore and aft of a center of gravity of the power trowel, respectively, and are located on a longitudinal centerline of the trowel so as to be coaxial.

17. A method comprising:

providing a power trowel having a frame and at least one rotor assembly including a rotatable shaft and a plurality of blades, and operating a single lift mechanism to concurrently move at least two spaced wheels from a stowed position in which the wheels are located above the bottoms of the blades and the blades are supported on a surface to an operative position in which the wheels forcibly lift the blades off the ground and fully support the power trowel on the surface.

18. The method of claim 17, wherein the operating step comprises operating a jack to rotate a shaft to lower the wheels relative to the frame.

19. The method of claim 17, wherein the wheels are located fore and aft of a center of gravity of the power trowel, respectively, and are located on a longitudinal centerline of the trowel so as to be coaxial.

20. The method of claim 17, further comprising maintaining the wheels within a footprint of the remainder of the power trowel.

21. A transport system for a riding power trowel, the power trowel having a plurality of blades that are supported for rotation relative to a frame of the power trowel, and a cage that overlies and surrounds the blades, the transport system comprising:

first and second wheels having axial centerlines that are spaced from one another;

a connector that supports the first and second wheels on the frame; and a lift device that is operationally connected to the frame and that can be operated to concurrently raise and lower the first and second wheels relative to the frame;

wherein the wheels are located fore and aft of a center of gravity of the power trowel, respectively, and are located on a longitudinal centerline of the trowel.

* * * * *

UNITED STATES PATENT AND TRADEMARK OFFICE

CERTIFICATE OF CORRECTION

PATENT NO. : 7,771,139 B2
APPLICATION NO. : 11/839967
DATED : August 10, 2010
INVENTOR(S) : Grahl It is certified that error appears in the above-identified patent and that said Letters Patent is hereby corrected as shown below:

TITLE PAGE, ITEM 57 IN THE ABSTRACT

Line 2 — Replace “towel” with -- trowel --

IN THE SPECIFICATION

Col. 1, Line 66 — Replace “labor some” with -- laborsome --

IN THE CLAIMS

CLAIM 17
Col. 10, Line 6 — Replace “ground” with -- surface --

Signed and Sealed this
Fourteenth Day of August, 2012

David J. Kappos

David J. Kappos
*Director of the United States Patent and Trademark Office*